US009756686B2

(12) United States Patent
Dohmeier et al.

(10) Patent No.: US 9,756,686 B2
(45) Date of Patent: Sep. 5, 2017

(54) METHOD OF CROSSTALK REDUCTION FOR MULTI-ZONE INDUCTION HEATING SYSTEMS

(75) Inventors: Nicholas Dohmeier, Surrey (CA); Keith McCormick, Burnaby (CA)

(73) Assignee: Honeywell ASCa, Inc., Mississauga (CA)

( * ) Notice: Subject to any disclaimer, the term of this patent is extended or adjusted under 35 U.S.C. 154(b) by 1067 days.

(21) Appl. No.: 12/964,963

(22) Filed: Dec. 10, 2010

(65) Prior Publication Data

US 2011/0139770 A1 Jun. 16, 2011

Related U.S. Application Data

(60) Provisional application No. 61/286,798, filed on Dec. 16, 2009.

(51) Int. Cl.
*H05B 6/06* (2006.01)

(52) U.S. Cl.
CPC ..... *H05B 6/065* (2013.01)

(58) Field of Classification Search
CPC . H05B 6/145; G06G 15/2053; G06G 15/2078
USPC .... 219/619, 216; 399/328–335, 338, 69, 45, 399/33
See application file for complete search history.

(56) References Cited

U.S. PATENT DOCUMENTS

| | | | | |
|---|---|---|---|---|
| 4,631,794 | A * | 12/1986 | Riihinen | 492/8 |
| 4,675,487 | A * | 6/1987 | Verkasalo | 219/619 |
| 5,047,734 | A | 9/1991 | Newell et al. | |
| 5,059,762 | A | 10/1991 | Simcock | |
| 6,498,477 | B1 | 12/2002 | Govari et al. | |
| 6,689,993 | B2 * | 2/2004 | Saynavajarvi | 219/619 |
| 2002/0019172 | A1 | 2/2002 | Forbes et al. | |
| 2009/0074442 | A1 * | 3/2009 | Sano et al. | 399/69 |
| 2010/0200570 | A1 | 8/2010 | Chirico et al. | |

FOREIGN PATENT DOCUMENTS

FR 2863039 A1 6/2005

* cited by examiner

*Primary Examiner* — Tu B Hoang
*Assistant Examiner* — Thomas Ward
(74) *Attorney, Agent, or Firm* — Charles H Jew

(57) ABSTRACT

Reduction of crosstalk between induction heating coils in an induction heating apparatus and particularly to reduction of crosstalk in a multi-zone induction heating system provides greater reliability for the power modules.

10 Claims, 3 Drawing Sheets

METHOD OF CROSSTALK REDUCTION FOR MULTI-ZONE INDUCTION HEATING SYSTEMS

RELATED APPLICATION DATA

The present application is claims priority under 35 U.S.C. §119(e) to application for Method of Crosstalk Reduction for Multi-zone Induction Heating Systems, Application No. 61/286,798 filed Dec. 16, 2009, which is incorporated herein by reference.

TECHNICAL FIELD OF THE INVENTION

The present invention generally relates generally to induction heating apparatus and, more particularly, to methods for reducing crosstalk between induction heating coils in such heating apparatus.

BACKGROUND OF THE INVENTION

In typical induction heating systems, accurate and close control of the operating temperature of the workload is generally required. Moreover, it may become necessary for various sections of the workload to require different levels of heating such that each section of the workload must be closely controlled for accuracy.

For example, Simcock, U.S. Pat. No. 5,059,762, discloses a multi-zone induction heating system which includes a plurality of inductive coil sections. Each of the inductive coil sections is associated with a respective zone of the work load. Power from a supply is applied to each one of the coil sections through a respective one of a plurality of saturable reactors. Each one of the saturable reactors is operable to shunt a proportion of supply power to its respective inductive coil section in response to a demand signal derived from the operation of the respective zone for such induction coil section. Accordingly, the temperature in each zone is regulated independently of the regulation of the other zones.

Increased precision in the temperature regulation of the work load may necessitate that the regulated zones become smaller. Smaller zones may further necessitate smaller zone spacing between inductive coil sections, thereby bringing the work coil in each section closer the work coil in neighboring sections. Since a high frequency current is applied to each work coil to develop the inductive field used to heat the work load, such field developed by one work coil may in part pass through the core of a neighboring work coil causing magnetic interference or energy transfer between coils, thereby resulting in crosstalk between coils.

It is readily seen that crosstalk may then become more severe as the work coils are brought closer together. As crosstalk increases, the reliability of the each of the power modules driving each respective one of the work coils is significantly reduced. Accordingly, a need exists to reduce crosstalk in a multi-zone induction heating system in order to provide greater reliability for the power modules.

SUMMARY OF THE INVENTION

It is therefore an object of the present invention to reduce crosstalk in a multi-zone induction heating system in order to provide greater reliability for the power modules.

The present invention advantageously provides techniques of reducing crosstalk between work coils of a multi-zone induction heating system. In one aspect, the invention provides an induction heating apparatus including induction coil means operatively associated with a melt or other work load to be heated, where the coil is divided into a plurality of defined sections each associated with a respective zone of the workload in use. A power supply generates power input to the induction coil means. There is also a control means for regulating the power applied to each of said sections of the work coils for regulation of the operating temperature in the respective associated zone.

In another aspect, the present invention provides is a method of synchronizing the audio or higher frequency, high power currents flowing through the induction heating work coils such that the crosstalk, which is magnetic interference or energy transfer, between coils is reduced.

In preferred embodiments of the present invention, the coils are driven at identical frequencies and the phase shift between them synchronized so as to minimize crosstalk between the coils. Crosstalk between the coils is significantly reduced when the coils are running at the exact same frequency and the phase shift between the coil currents is between −90 and +90 degrees. When the coils are exactly in phase, there is no crosstalk between the coils. Crosstalk is generally reduced to much more manageable levels as long as the phase difference between the coils does not exceed 90 degrees. This would generate reduced heating zone width as the crosstalk between coils through the roll is reduced; thus reducing widening of the coil footprints from unwanted heat generation between zones. As a result, the system efficiency will improve slightly as less power is required for the same amount of heating.

These and other objects, advantages and features of the present invention will become readily apparent to those skilled in the art form a study of the following Description of the Exemplary Preferred Embodiments when read in conjunction with the attached Drawing and appended Claims.

DESCRIPTION OF THE EXEMPLARY PREFERRED EMBODIMENTS

Figure 1:
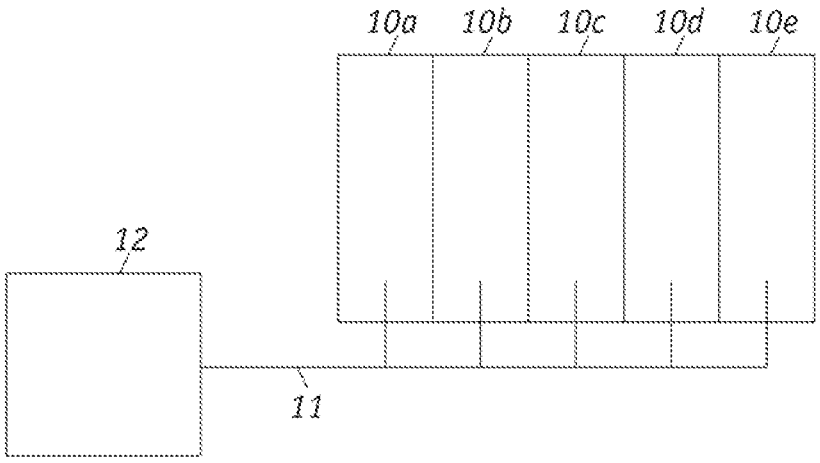
FIG. 1 illustrates the synchronization of work coil currents by a common signal.

Referring now to FIG. 1, a typical induction heating apparatus includes, inter alia, a power module 10, which may be exemplarily divided into five power module sections 10. It is to be recognized that any number of power module sections may be used and therefor any such number is within the scope of the present invention.

As is well known in the art, each section $\mathbf{10}_{a\text{-}e}$ of the power module 10 is associated with a segment of an induction work coil (not shown) to be operatively associated with a respective zone of the work load (not shown). Also as is well known in the art, each of the power module sections $10_{a-e}$ develop the work coil currents for its associated work coil.

In accordance with the present invention, a common synchronizing signal 12 is sent to each of the power module sections $10_{a-e}$. Exemplarily, the synchronizing signal may be high precision synchronization pulses. The synchronizing signal may be communicated wirelessly or via a wire 11. The synchronizing signal 12 is applied to existing hardware within the power module sections $10_{a-e}$ which is responsive to the timing information provided by the synchronizing signal such that the power module sections $10_{a-e}$ are locked onto the timing information. Dedicated hardware within conventional power module sections $10_{a-e}$ may be provided for synchronization.

Exemplarily, the synchronizing signal 12 may be a synchronization pulse that is applied to each one of power module sections $10_{a-e}$, each of which is associated with a respective one of the work coils. A phase of the work coil current developed from a common power source at each one of the power module sections $10_{a-e}$ is shifted such that the current applied to each respective one of the work coils is phase synchronized.

Figure 2:
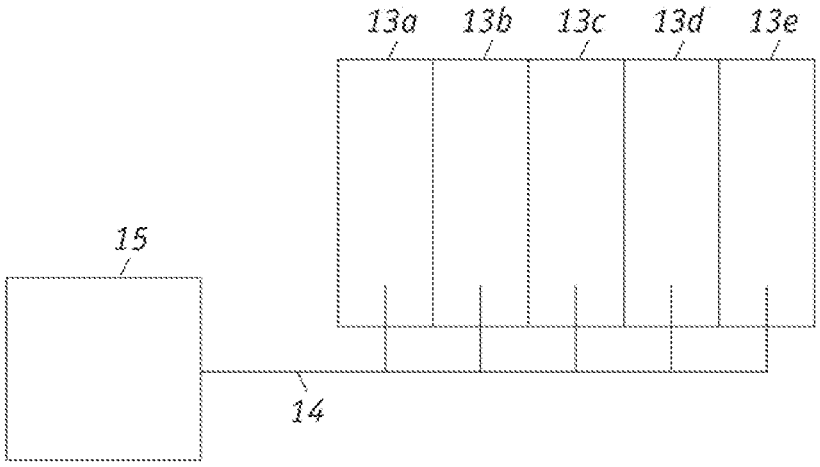
FIG. 2 illustrates the synchronization of work coil currents to common incoming power.

Referring now to FIG. 2, another exemplary embodiment of the present invention is described. As shown in FIG. 2, an alternating current (AC) signal from a conventional three phase power source 15 is sent to each one of the power module sections $13_{a-e}$ via a wire 14 or wirelessly. The timing information used to synchronize the work coil currents may be extracted by power module sections $13_{a-e}$ from the AC signal provided by the power source 15. For example, the timing information would be of phase timing gleaned from zero-crossings of incoming three phase power or other accurately measurable instance. Conventional hardware within the power module sections $13_{a-e}$ can detect the time of the zero-crossing of the incoming AC power.

It is therefore apparent that the multi-zone induction heating system has a plurality work coils powered from a three phase power source which provides a synchronization pulse to each one of a plurality of power controllers, each of the power controllers being associated with a respective one of the work coils. A phase of a current developed from the power source at each one of the power controllers in response to the synchronization pulse shifts such that the current applied to each respective one of said work coils is phase synchronized.

Furthermore, the zero crossing in the three phase power can be used to develop timing information from the detected three phase crossings. Likewise, the synchronization pulse can be developed commensurately with the timing information.

Figure 3:
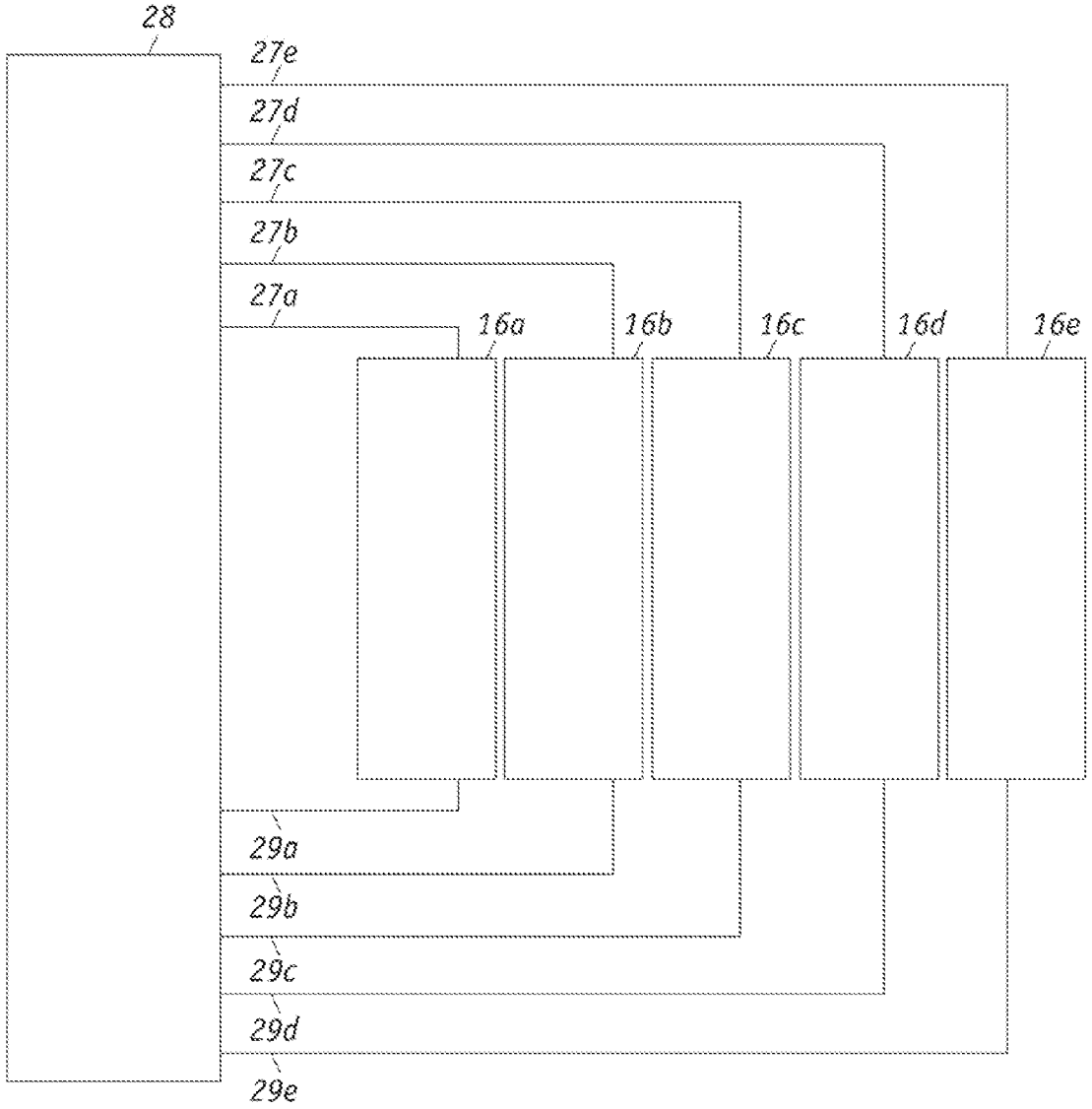
FIG. 3 illustrates the synchronization of work coil currents by continuous phase modulation to minimize measurable crosstalk.

Referring now to FIG. 3, yet another embodiment of the present invention is described. As shown in FIG. 3, outputs for crosstalk distortion detection from power module sections $16_{a-e}$ are sent via wires $27_{a-e}$ or wirelessly to a processing device 28. The processing device 28 continuously monitors the power module sections $16_{a-e}$ to detect severe crosstalk. The detected crosstalk induced distortions indicate a phase difference between a module and its neighbors. The processing device 18 shifts the phase of the work coil current until crosstalk distortions are no longer detected.

As an alternative to applying a synchronizing or timing signal to maintain synchronization between work coils, as described in the present embodiment, the distortions are detected to indicate lack of synchronization. By shifting phase until such distortion is minimized the synchronization is accomplished. The outputs from processing device 18 are communicated via wires $29_{a-e}$ or wirelessly to power module sections $16_{a-e}$. Thereby, the multi-zone induction system reaches a steady-state condition with minimal crosstalk. This is an example that generally applies where all or at least a few of the power modules are already powered up.

Also in FIG. 3, steady state can be achieved more quickly by powering up the individual zones associated with power module sections $16_{a-e}$ one after another so that each zone can synchronize to its neighbor without any potentially conflicting crosstalk from another neighbor. For example, power module sections $16_a$ is first turned on without any crosstalk. Next power module section $16_b$ is turned on and locked onto the signal of power module section $16_a$. Likewise, power module section $16_c$ is turned on next and locked onto power modules $16_a$ and $16_b$.

The process continues until all power module sections $16_{a-e}$ are powered on. Note that the number of power modules is arbitrary in number and the process continues until all power modules are powered on and locked onto all previously powered on power modules. This example generally applies where the power modules were not previously powered up.

Additionally as shown in FIG. 3, principles from the previous two methods are combined and applied to a heating system with some power modules already powered up and others not. An example of this is where power module sections $16_a$ and $16_b$ are powered up and power module sections $16_c$, $16_d$ and $16_e$ are not powered up. If the power modules are to be powered up successively, power module section $16_c$ would be powered on and lock onto power module sections $16_a$ and $16_b$. Next, power module section $16_c$ is powered on and lock onto all previously powered on power module sections $16_a$, $16_b$ and $16_c$. Lastly, power module section $16_e$ is powered on and lock onto all previously powered on power module sections $16_a$, $16_b$, $16_c$ and $16_d$.

While the power module sections are being powered on successively, the phase information of the originally powered on power module sections $16_a$ and $16_b$ would be constantly calibrated to minimize crosstalk between their respective work coils. Likewise, the entire system of power module sections $16_{a-e}$ would constantly be calibrated amongst each other in order to minimize crosstalk between their respective work coils. For example, even while power module sections $16_c$, $16_d$ and $16_e$ were being powered on and calibrated to already powered on power module sections $16_a$ and $16_b$, power module sections $16_a$ and $16_b$ are also being calibrated to synchronize with all subsequently powered on power module sections $16_c$, $16_d$ and $16_e$.

Furthermore, in FIG. 3, the calibration between power module sections $16_{a-e}$ to reduce crosstalk among their respective work coils could either be sequentially before or after one or more coils are powered on or simultaneously while or after one or more coils are powered on.

Thus, by monitoring a current through each one of a plurality of induction coils in each respective one of the power module sections $16_{a-e}$ for the heating system the processing device 18 continuously detects in each of these currents crosstalk induced from the current in each other one of the induction coils from which crosstalk a phase difference between the current in one of the induction coils and the current in one other of the induction coils can be determined. Thereby, the phase of the current of at least one of the induction coils and another induction coil is shifted until crosstalk is substantially eliminated.

This may also be done sequentially, one at a time. For example, a coil may have a current run through it initially to determine a steady state condition for it. After which, subsequent coils will be calibrated one at a time to match the same steady state of the first coil until all coils reach the same steady state condition. This process may initiate with a system with no currents running through the coils or with currents already running through a few coils. In the latter case, the coils with currents already running through them will also calibrate themselves to coils that subsequently have currents running through them. These processes may continue until all coils are synchronized and/or crosstalk is substantially eliminated.

Figure 4:
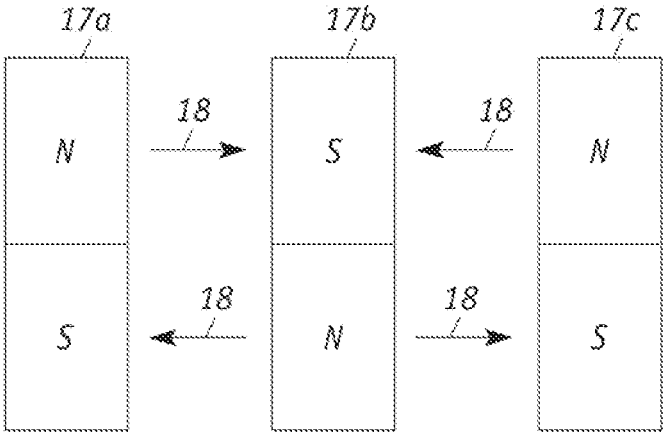
FIG. 4 illustrates how crosstalk exists when there are non-calibrated or otherwise random phases or frequencies in the induction coil.

Furthermore, synchronizing the work coil currents precludes individual zone power level control by frequency variation. Thus the methods described are particularly applicable when using duty cycling to control individual zone output power. This is illustrated in FIG. 4 in which unsynchronized coils practically equates to random phases between the coils, illustrated by the North (N) and South (S) polarity of the coils 17*a, b* and *c*, which cause crosstalk 18 or significant energy flow between the coils. Indeed, heat rolls between the coils as energy flows between the coils.

Figure 5:
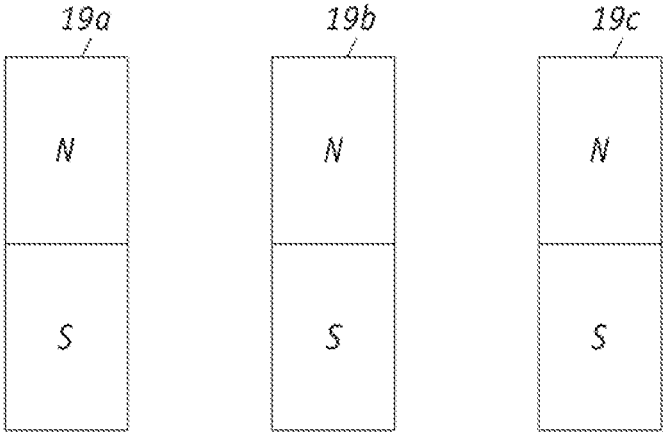
FIG. 5 illustrates how crosstalk is minimized or eliminated when there are calibrated or otherwise identical phases and frequencies in the induction coil.

FIG. 5 illustrates an example where the coils are synchronized such that the coils 19*a, b* and *c*. are exactly in phase. This is illustrated by the North (N) and South (S) polarity of the coils 19*a, b* and *c*. Since as there is no energy flow between the coils, there is no crosstalk between the coils 19*a, b* and *c*.

Various methods for synchronizing the work coil currents have been herein disclosed. One method employs a common synchronizing signal, such as high frequency pulses, which would include sufficient timing information for the power modules to lock onto. This method uses hardware within the power modules for the synchronization of the power modules. The synchronization could be achieved through a wired or wireless signal.

Another method extracts timing information from the common incoming 3-phase power. This would then be used to synchronize the work coil currents. The phase timing can be gleaned from zero-crossing of incoming power or other accurately measurable input. The difficulty with this method is the inaccurate and imprecise timing information in the common power. Additional hardware is needed to detect the time of the zero-crossing of the incoming AC power.

Yet another method uses existing crosstalk distortion detection to nudge the phases of different work coils until the crosstalk distortions are no longer being reported. In this method, the inverter and/or work coil currents are continuously monitored to detect severe crosstalk. These detected crosstalk induced faults indicate a phase difference between a module and its neighbors. By slowly shifting the phase of the work coil current until crosstalk distortions are no longer detected, no synchronizing or timing signal is required. The multi-zone induction system reaches a steady-state condition with minimal crosstalk.

Additionally, steady state can be achieved more quickly by powering up the individual zones one after another so that each zone can synchronize to its neighbor without any potentially conflicting crosstalk from another neighbor. This method results in the lowest cost solution as no additional hardware is needed. This method is unique in that it uses the work coil currents of neighboring zones as a timing source.

There has been described above a novel apparatus and methods for reducing crosstalk in multi zone induction heating systems. Those skilled in the art may now make numerous uses of, and departures from, the above described embodiments without departing from the lawfully permitted scope of the appended Claims.

What is claimed as the invention is:

1. A method for controlling the annular phase of a plurality of alternating currents wherein each of the alternating currents is applied to a respective one of a plurality of adjacently disposed induction coils comprising the steps of:

developing each one of the currents from a respective one of a plurality of power modules such that each one of the currents has a frequency substantially similar to the frequency of each other one of the currents;

applying a synchronization pulse to each of the power modules;

detecting continuously in each one of the currents developed by each respective one of the power modules whether a distortion has been induced in any one of the currents as a result of magnetic field interference in the respective one of the induction coils to which the current in which the distortion is detected is applied wherein the magnetic field interference results from a magnetic field developed by the current in an adjacent one of the induction coils; and shifting in the event a distortion is detected in one of the currents the phase of a selected one of the current in which the distortion is detected and the current which is applied to the adjacent one of the induction coils, wherein the phase of the current developed by each respective of the power modules is relative to the synchronization pulse applied to each of the power modules, until the distortion is substantially eliminated whereby magnetic field induced crosstalk between the adjacent ones of the induction coils is mitigated.

2. A method for controlling the angular phase of a plurality of alternating currents as set forth in claim 1 further comprising the steps of:

initiating the current in a first one of the induction coils until a predetermined steady state condition has been obtained for said first one of the induction coils;

initiating the current in a next successive one of the induction coils until the steady state condition has been obtained for said next successive one of the induction coils; and repeating the detecting step and the shifting step until the detecting step is determinative of substantial elimination of distortion in the current of the first one of the induction coils.

3. A method for controlling the angular phase of a plurality of alternating currents as set forth in claim 2 further comprising the steps of:

initiating sequentially the current in a present one of further successive ones of the induction coils until the steady state condition has been obtained for the present one of the further successive ones of the induction coils; and repeating the detecting step and the shifting step until the detecting step is determinative of substantial elimination of cross talk between the current in the present one of the further successive ones of the induction coils and the current in an immediately prior one of the further successive ones of the induction coils.

4. A method for controlling the angular phase of a plurality of alternating currents as set forth in claim 1 wherein said phase shifting step includes the steps of:

shifting a phase of a current developed from a prime power source in response to the synchronization pulse as the current from the prime power source is being applied to each of the power modules such that the current applied to each respective one of the work coils is phase synchronized.

5. A method for controlling the angular phase of a plurality of alternating currents as set forth in claim 4 further comprising the step of:

detecting a zero crossing in a three phase power source; and developing timing information from said detected three phase crossings, the synchronization pulse being developed commensurately with the timing information.

6. In a multi-zone induction heating system having a plurality of power module sections to which a current from a power source is applied and a plurality of work coils, each of said work coils being associated with a respective one of said power module sections which develops an alternating work coil current for said associated one of said work coils wherein each alternating current developed by each one of the power module sections has a frequency substantially similar to the frequency of the alternating current developed by each other one of the power module sections, a method for controlling the angular phase of each alternating work coil current comprising the steps of:

applying a synchronization pulse to each of the power modules;

detecting continuously in the work coil current developed by each respective one of said power module sections whether a distortion has been induced in any one work coil current as a result of magnetic field interference in the respective one of the work coils to which the current in which the distortion is detected is applied wherein the magnetic field interference results from a magnetic field developed by the current in an adjacent one of said work coils; and shifting in the event a distortion is detected in any one work coil current the phase of a selected one of said work coil current in which the distortion is detected and the current which is applied to the adjacent one of said work coils, wherein the phase of the current developed by each of the power module sections is relative to the synchronization pulse applied to each of the power module sections, until the distortion is substantially eliminated whereby magnetic field induced crosstalk between the adjacent ones of the induction coils is mitigated.

7. A method for controlling the angular phase of each alternating work coil current as set forth in claim 6 further comprising the steps of:

initiating said work coil current in a first one of said work coils until a predetermined steady state condition has been obtained for said first one of said work coils;

initiating said work coil current in a next successive one of said work coils until the steady state condition has been obtained for said next successive one of said work coils; and repeating the detecting step and the shifting step until the detecting step is determinative of substantial elimination of distortion in said work coil current of said first one of said work coils.

8. A method for controlling the angular phase of each alternating work coil current as set forth in claim 7 further comprising the steps of:

initiating sequentially said work coil current in a present one of further successive ones of said work coils until the steady state condition has been obtained for the present one of the further successive ones of said work coils; and repeating the detecting step and the shifting step until the detecting step is determinative of substantial elimination of cross talk between said work coil current in the present one of the further successive ones of said work coils and said work coil current in an immediately prior one of the further successive ones of said work coils.

9. A method for controlling the angular phase of each alternating work coil current as set forth in claim 6 wherein said phase shifting step includes the steps of:

shifting a phase of a current developed from said power source at each one of the power module sections in response to the synchronization pulse such that said work coil current applied to each respective one of the work coils is phase synchronized.

10. A method for controlling the angular phase of each alternating work coil current as set forth in claim 9 further comprising the step of:

detecting zero crossing in said power source wherein said power source is a three phase source; and developing timing information from said detected three phase crossings, the synchronization pulse being developed commensurately with the timing information.

* * * * *